US006752516B1

(12) United States Patent
Beadle

(10) Patent No.: US 6,752,516 B1
(45) Date of Patent: Jun. 22, 2004

(54) LIGHT FIXTURE MOUNTING

(76) Inventor: Joshua Z. Beadle, 5362 Caminito Vista Lujo, San Diego, CA (US) 92130

( * ) Notice: Subject to any disclaimer, the term of this patent is extended or adjusted under 35 U.S.C. 154(b) by 0 days.

(21) Appl. No.: 10/283,735

(22) Filed: Oct. 30, 2002

Related U.S. Application Data

(60) Provisional application No. 60/340,937, filed on Oct. 30, 2001.

(51) Int. Cl.[7] ..... H01R 88/00

(52) U.S. Cl. ..... 362/226; 362/382; 362/418; 362/191

(58) Field of Search ..... 362/226, 190, 362/191, 382, 388, 391, 396, 418, 285

(56) References Cited

U.S. PATENT DOCUMENTS 4,094,487 A * 6/1978 Heard ..... 248/230.9
4,290,094 A 9/1981 Jensen
4,516,193 A * 5/1985 Murphy ..... 362/123
4,760,510 A 7/1988 Lahti
5,436,810 A * 7/1995 Sutherland et al. ..... 362/473
5,526,250 A * 6/1996 Ting et al. ..... 362/391
6,491,407 B1 12/2002 Beadle

* cited by examiner

*Primary Examiner*—Thomas M. Sember
(74) *Attorney, Agent, or Firm*—Procopio, Cory, Hargreaves & Savitch LLP

(57) ABSTRACT

The light fixture mounting has a body with a base releasably attached thereto. The base includes fastening means for attaching the base to the mounting surface. In one embodiment, the fastening means comprises a circular strap retained within a slot or channel formed in the base. The strap has an adjustable diameter which allows the base to be attached to a structure such as a tree trunk or limb by encircling the trunk or limb with the strap, then tightening the strap around the trunk or limb. In a preferred embodiment, the base is configured both with slots for receiving a strap and bores for receiving screws to allow a single base configuration to be used for different mounting situations. Once the base is mounted on the mounting surface, the body is attached to the base by means of a releasable attachment means such as a bayonet mounting or locking screws inserted through the body into the base. The distal end of the body is adapted for attachment to a light fixture, typically by providing a threaded bore for receiving a threaded boss extending from the light fixture.

15 Claims, 3 Drawing Sheets

LIGHT FIXTURE MOUNTING

RELATED APPLICATIONS

This application claims the priority of U.S. provisional application Serial No. 60/340,937, filed Oct. 30, 2001, the disclosure of which is incorporated herein by reference.

FIELD OF THE INVENTION

This invention relates to a device for mounting a light fixture to a surface, and more particularly, to a device capable of mounting a light fixture to structures having curved or flat surfaces.

BACKGROUND OF THE INVENTION

Architectural lighting has become increasingly popular as a method of accenting a structure and/or its surrounding landscape. Architectural lighting systems have been used to direct light into a tree from below, known as uplighting, to direct light downward from the tops of trees and eves, known as downlighting, and for other purposes. In such systems, individual lights are positioned in various manners to direct light towards various targets. In some situations, lights are attached to stakes and placed in the ground. In others, lights are attached to trees. Typically, the lights are attached to the trees using screws and nails. While nailing or screwing a light fixture to a tree is a cost efficient method of attaching a light to a tree, it unnecessarily injures the tree and may even result in death of the branch or the entire tree. This may especially be true when the "tree" is a tall cactus or succulent. Further, light fixtures that are capable of being attached to a tree may have a base that is shaped differently than the same styled light fixture that is capable of being attached to a wall. As a result, light manufacturers are often required to offer several different bases for use in different applications. Thus, a need exists for a light fixture having a base that can be attached to a tree, or other generally curved surface, without requiring that nails or screws be driven into the tree and that can be attached to either a curved surface, such as a tree, or to a generally flat surface.

BRIEF SUMMARY OF THE INVENTION

In an exemplary embodiment, a light fixture mounting has a body and a base releasably attachable to the proximal end of the body. The base may be shaped to conform to a mounting surface and includes fastening means for attaching the base to the mounting surface. In one embodiment, the fastening means comprises a circular strap retained within a slot or channel formed in the base. The strap has an adjustable diameter which allows the base to be attached to a structure such as a tree, pole or post by encircling the structure with the strap, then tightening the strap around the structure. In a second embodiment, the fastening means comprises at least one bore through which a screw or other fastener may be passed for attachment to a wall or column. In a preferred embodiment, the base is configured both with slots for receiving a strap and bores for receiving screws to allow a single base configuration to be used for different mounting situations. Once the base is mounted on the mounting surface, the body is attached to the base by means of a releasable attachment means such as a bayonet mounting or locking screws inserted through the body into the base. The distal end of the body is adapted for attachment to a light fixture, typically by providing a threaded bore for receiving a threaded mounting post extending from the light fixture.

For mounting on a tree trunk or branch, one end of the strap is released from the base and passed around the structure then is inserted back into the base so that a circle is formed around the structure. A screw or clamp mechanism is used to tighten the strap so that the base is held firmly against the structure. In this application, it is unnecessary to insert a fastener into the trunk or branch so that the tree is undamaged.

BRIEF DESCRIPTION OF THE DRAWINGS

The accompanying drawings, which are incorporated in and form a part of the specification, illustrate embodiments of the present invention and, together with the description, disclose the principles of the invention, wherein.

DETAILED DESCRIPTION OF THE PREFERRED EMBODIMENTS

The following detailed description of the preferred embodiments of the present invention may contain positional references such as "top" and "bottom" or "upper" and "lower". Such references merely provide relative positioning when referring to the device as illustrated in the figures and are not intended to suggest a limit as to the possible orientations for installation of the light fixture mounting.

Figure 1:
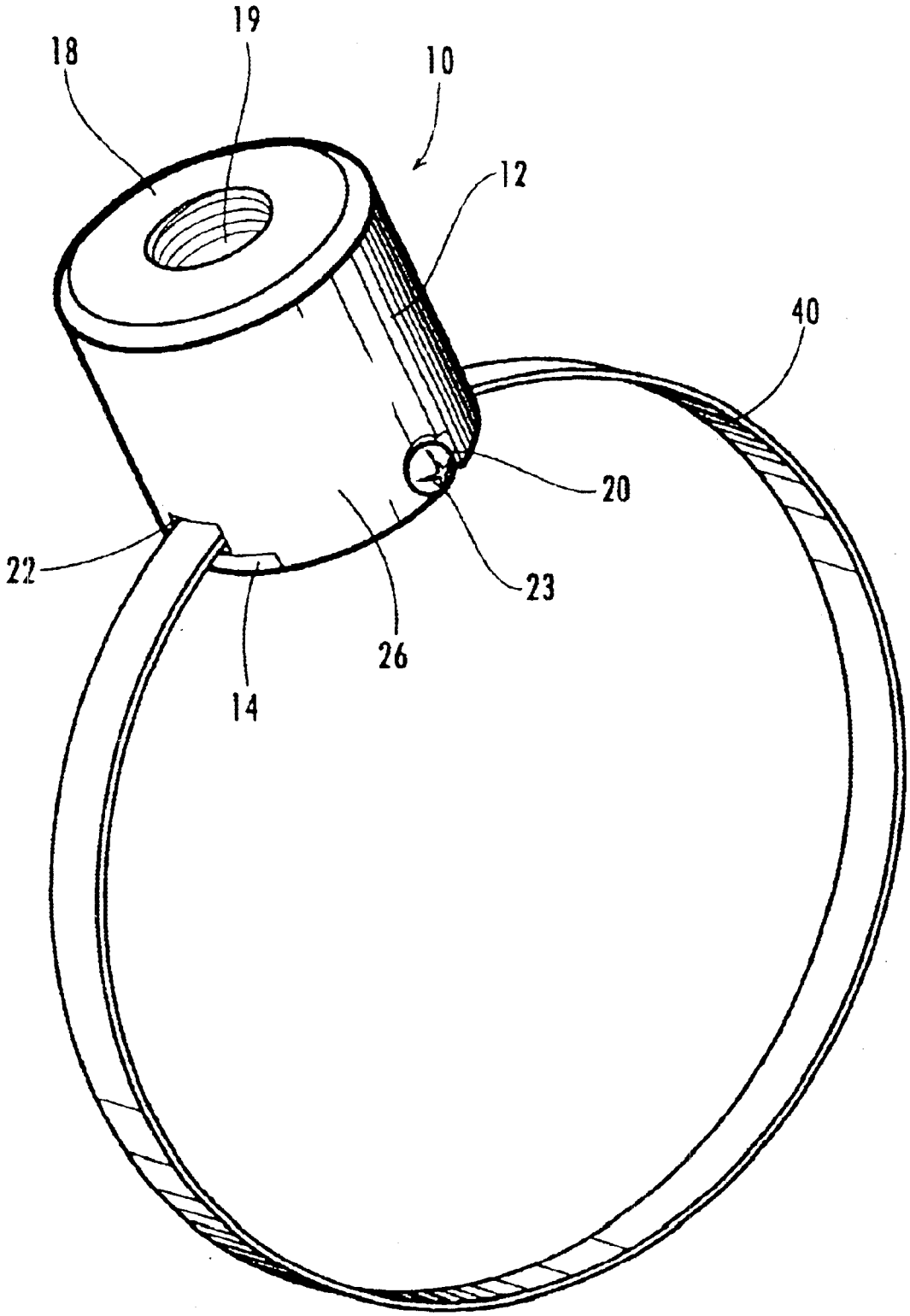
FIG. 1 is a perspective view of the light mounting with an adjustable strap for attachment to a tree or post.
Figure 2A:
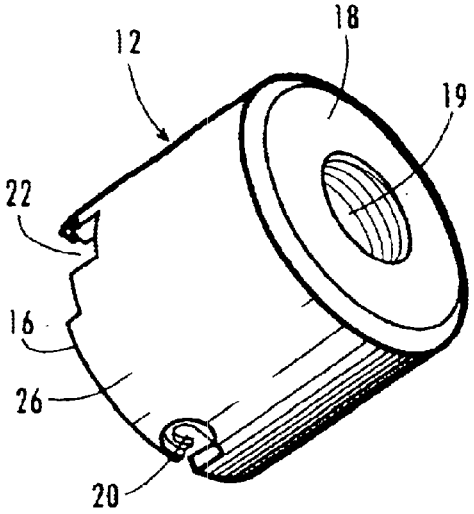
FIG. 2*a* is a top perspective view of the body of the light mounting.
Figure 2B:
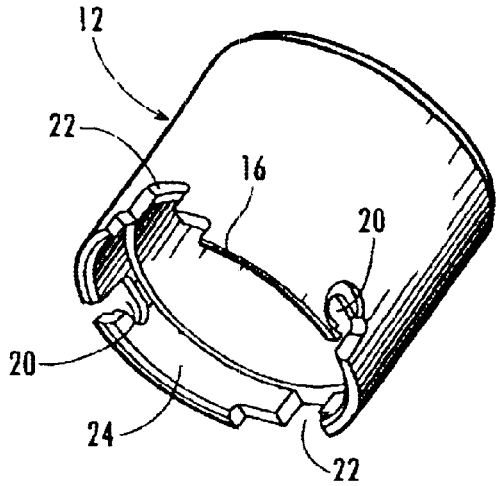
FIG. 2*b* is a bottom perspective view of the body of the light mounting.
Figure 4:
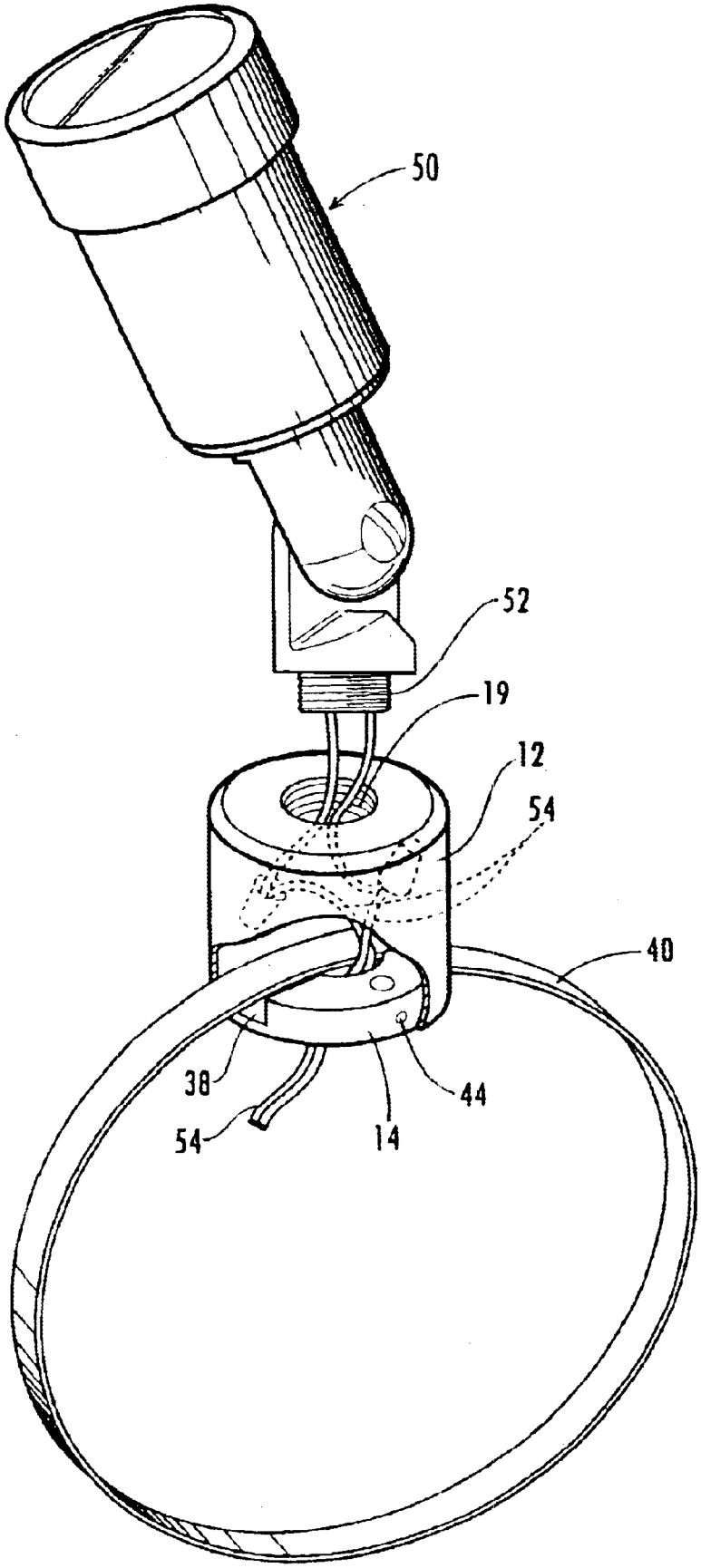
FIG. 4 is a perspective view of an exemplary light fixture with a threaded boss for attachment to the light mounting of the present invention.

According to the present invention, a versatile light fixture mounting 10 is provided for attachment to virtually any mounting surface, regardless of whether the surface is flat, such as a wall, or curved, such as poles, tree limbs and trunks. Light fixture mounting 10 is composed of an at least partially hollow body 12 and a base 14. Body 12, as shown in FIGS. 1, 2*a* and 2*b*, has a fully open proximal end 16 and a partially closed distal end 18. In the preferred embodiment shown, the body is cylindrical in shape, however, other shapes, for example, square or rectangular boxes, may be used. The distal end 18 includes a threaded opening 19 for receiving a light fixture, an example of which is shown in FIG. 4. However, light fixture mounting 10 is not limited to receiving only the light fixture shown in FIG. 4, rather, light fixture mounting 10 can receive different light fixtures. At the proximal end 16, body 12 includes two retention slots 20 and two-pass-through slots 22. Retention cavities 20 are formed in a general "L" shape for receiving the shaft of a screw 23. Further, retention slots 20 include a counter bore capable of receiving a head of a screw 23. Pass through slots 22 are sized large enough to receive a strap 40 and electrical wires that are used to deliver electrical current to the light fixture.

Body 12 has an outside surface 26 and a recessed or hollow portion with an inside surface 24. The dimensions of inside surface 24 are selected so that body 12 is capable of receiving base 14. In addition, the hollow portion creates a cavity for retaining an excess length of wire required to provide enough slack for connection of the light fixture plus any connectors that might be used. For mounting a compact lighting fixture, exemplary dimensions are on the order of 35 to 65 mm (about 1.5 to 2.5 inches), however, appropriate dimensions will depend on the size of the fixture and the nature and size of the surface on which it is to be mounted.

Figure 3A:
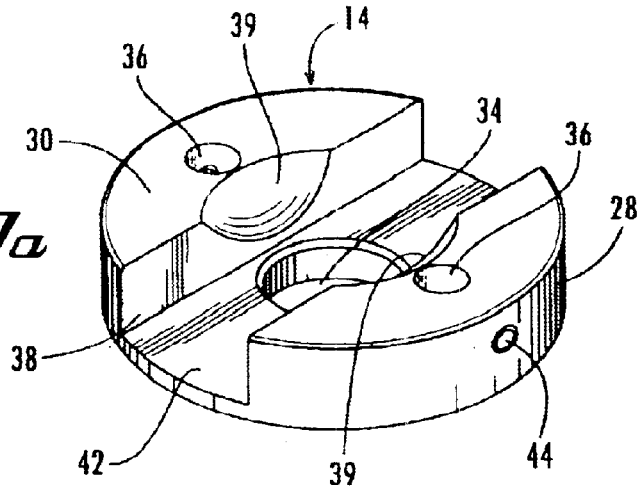
FIG. 3*a* is a top perspective view of the base of the light mounting.
Figure 3B:
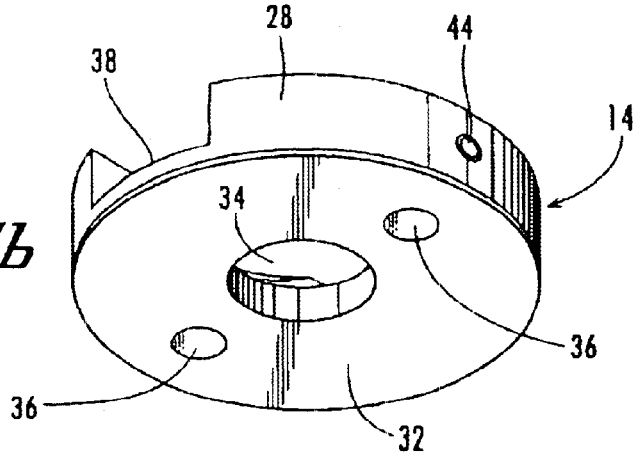
FIG. 3*b* is a bottom perspective view of the base of the light mounting.

Base 14, as shown in FIGS. 3*a* and 3*b*, is generally flat and cylindrical. The outside surface 28 of base 14 has a diameter that is slightly smaller than the inside surface 24 of body 12 so that base 14 fits within the recessed portion of body 12. While body 12 and base 14 are shown having generally cylindrical exterior shapes, both body 12 and base 14 can have a different exterior shape so long as the body 12 is capable of being attached to base 14. In the preferred embodiment, the base 14 fits closely within the recessed portion of body 12 so that its outer surface is flush with the proximal edge 16 of body 12. Base 14 further includes a top surface 30 and a bottom surface 32. Bottom surface 32 is generally flat; however, it can be curved to conform to a curved mounting surface. A bore 34 is formed through base 14 to allow electrical wires to be fed into mounting 10 for attachment to the lighting fixture. A single bore 34 is positioned generally within in the center of surface 32, however, multiple bores 34 may be formed in base 14 off-center to allow the user to select the approach angle for feeding the electrical wires into the body. Two smaller bores 36 are formed on opposing sides of the first hole to permit insertion of attachment screws when the mounting 10 is to be attached to a flat surface such as a wall or fence. Top surface 30 has a groove 38 formed therein for receiving a strap 40. Groove 38 can be formed with a slight convex curvature in its floor 42 to conform to strap 40. In an alternative embodiment, floor 42 can be flat. Bevel 39 is formed in the edges of groove 38 adjacent bore 34 to make it easier to feed the electrical wires through base 14 into the hollow interior of body 12. Base 14 also includes two or more threaded radial bores 44 in the outside surface 28 for receiving screws 23 that are used to secure the body 12 to the base 14.

Both body 12 and base 14 can be formed of various materials including metals, such as steel, stainless steel, galvanized steel, copper, brass, titanium, aluminum alloy, preferably painted or powder coated, and other metals. Alternatively, each part can be formed from a plastic or polymer, preferably, a non-flammable plastic selected from the Underwriter's Laboratories fire-rated plastics.

Light fixture mounting 10 is capable of being attached to a curved surface, such as a tree, or a flat surface. For instance, light fixture mounting 10 can be attached to a limb of a tree by first positioning base 14 on the surface of the limb. Strap 40 is then wrapped around the limb and tightened. An example of the light fixture mounting 10 with a strap 40 is shown in FIG. 1. The strap 40 can be formed from metal, e.g., stainless steel, spring steel, polyester, nylon, or other materials that provide the qualities of flexibility and durability. In one embodiment, the strap is configured similar to a worm gear hose clamp, which allows the strap to be contracted or expanded by turning screw that controls a worm drive. Alternatively, strap 40 can be tightened by pulling its ends around the limb, then secured using a conventional fastener such as crimps, clamps, buckles, adhesives or other fastening devices. Body 12 is then secured to base 14 by aligning the proximal end of body 12 with the outer surface 28 of base 14, then sliding the two sections together. During this process, screws 23 can already be in place in holes 36 or they can be inserted after sliding the parts together. As body 12 is placed on base 14, L-shaped retention slots 20 must be aligned with holes 44 and screws 23 on the outside surface 28 of base 14. After body 12 has been firmly pushed against base 14, it is rotated to secure screws 23 within retention slots 20. The screws 23 are then tightened against the outside surface of body 12 to prevent body 12 from being separated from base 14. In an alternate embodiment, the screws can be replaced by pins extending radially from base 14 so that a bayonet mount is created. A spring or other resilient element can be provided in or on base 14 to generate a bias against body 12 so that the bias must be overcome to slide the pins into the horizontal legs of retention slots 20. This bias then serves to hold the assembly together.

For placement of a light fixture on a flat surface such as a wall or fence, appropriate screws (not shown), for example, flat head wood screws, can be inserted through bores 36 in base 14 then screwed into the wall. Once the base 14 is firmly affixed, body 12 is attached to the base using the procedure described above.

Referring to FIG. 4, after light fixture mounting 10 has been attached to the mounting surface and assembled, the desired lighting fixture 50 can be attached by mating the threads on a boss 52 extending from the light fixture 50 with the threads of threaded bore 19 in body 12, after electrical connection of the light fixture to wires 54 from the voltage supply that were fed through the base 14 of mounting 10. As illustrated, body 12 is partially cut away to show how the electrical wires 54 are fed into the interior of body 12. The light fixture illustrated is intended to be exemplary only, and other fixtures as well as alternative means for attaching the fixture to the mounting 10 may be used.

The light mounting described herein provides a versatile means for attachment of a lighting fixture which allows fixtures to be attached to either a structure such as a wall or fence post having flat surface into which fasteners can be driven or a tree trunk or branch or other location where the use of conventional fasteners may be undesirable.

While various embodiments of this invention have been described above, these descriptions are given for purposes of illustration and explanation. Variations, changes, modifications and departures from the systems and methods disclosed above may be adopted without departure from the spirit and scope of this invention.

What is claimed is:

1. A light fixture mounting comprising:

a body having a hollow portion, a distal end and a proximal end, the distal end adapted for attachment to a light fixture;

a base having an outer dimension adapted to closely fit within the proximal end of the body, the base having an inner surface and an outer surface, the outer surface adapted to abut a structure onto which the light fixture is to be mounted, a first bore for feeding electrical wires into the hollow portion, and two separate receiving structures disposed within the base for receiving a mounting fastener for attaching the base to a structure onto which the light fixture is to be mounted; and a releasable fastener for fastening the body to the base; and the mounting fastener comprising one of a strap extending diametrically across the inner surface of the base and one or more insertion fasteners extending outward from the outer surface of the base.

2. The light fixture mounting of claim 1, wherein the structure onto which the light fixture is to be mounted is a tree trunk or limb and the mounting fastener comprises a strap having an adjustable length for encircling the tree trunk or limb, and wherein one of the two receiving structures comprises a recessed channel formed in the inner surface of the base having a width adapted for receiving the strap therein.

3. The light fixture mounting of claim 1, wherein the strap is formed from stainless steel.

4. The light fixture mounting of claim 1, wherein the structure onto which the light fixture is to be mounted is a flat surface and one of the two receiving structures comprises at least one second bore extending through the base and wherein the mounting fastener comprises at least one fastener adapted for insertion through the at least one second bore into the flat surface.

5. The light fixture mounting of claim 1, wherein the distal end of the body has a threaded bore formed therein for receiving a threaded boss extending from the light fixture.

6. The light fixture mounting of claim 1, wherein the body has a plurality of slots near the proximal end, the base has a plurality of threaded radial bores corresponding to the plurality of slots, and the releasable fastener comprises a plurality of screws adapted for insertion through the plurality of slots into the corresponding radial bores.

7. The light fixture mounting of claim 1, wherein the body and base are formed from metal selected from the group consisting of steel, stainless steel, copper, aluminum alloy, brass and titanium.

8. The light fixture mounting of claim 1, wherein the body and base are formed from a plastic or polymer.

9. The light fixture mounting of claim 1, wherein the mounting surface is a flat surface and the insertion fastener comprises a screw for insertion through the at least one second bore and into the flat surface.

10. A light fixture mounting comprising:

a base having an outer dimension, an inner surface and an outer surface, the outer surface adapted to abut a structure onto which the light fixture is to be mounted, a first bore for feeding electrical wires into the hollow portion, at least one second bore adapted for passing a fastener therethrough for insertion into the structure, and a recessed channel extending diametrically across the inner surface of the base;

one of:

(i) a strap for encircling a tree trunk or limb wherein the tree trunk of limb comprises the structure onto which the light fixture is to be mounted, the strap having a width adapted to fit within the recessed channel in the inner surface of the base and having an adjustable length for fitting the strap to the tree trunk or limb; and (ii) an insertion fastener for insertion through the at least one second bore into a mounting surface;

a body having a hollow portion, a distal end and a proximal end, the distal end adapted for attachment to a light fixture and the proximal end having an inner dimension adapted to receive the outer dimension of the base so that outer surface of the base is substantially flush with the proximal end of the body; and a releasable fastener for fastening the body to the base.

11. The light fixture mounting of claim 10, wherein the strap is formed from stainless steel.

12. The light fixture mounting of claim 10, wherein the distal end of the body has a threaded bore formed therein for receiving a threaded boss extending from the light fixture.

13. The light fixture mounting of claim 10, wherein the body has a plurality of slots near the proximal end, the base has a plurality of threaded radial bores corresponding to the plurality of slots, and the releasable fastener comprises a plurality of screws adapted for insertion through the plurality of slots into the corresponding radial bores.

14. The light fixture mounting of claim 10, wherein the body and base are formed from metal selected from the group consisting of steel, stainless steel, copper, aluminum alloy, brass and titanium.

15. The light fixture mounting of claim 10, wherein the body and base are formed from a plastic or polymer.

* * * * *